US009279312B2

(12) United States Patent
King

(10) Patent No.: US 9,279,312 B2
(45) Date of Patent: Mar. 8, 2016

(54) DOWNHOLE SLEEVE SYSTEM AND METHOD

(75) Inventor: James G. King, Kingwood, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 902 days.

(21) Appl. No.: 13/545,605

(22) Filed: Jul. 10, 2012

(65) Prior Publication Data

US 2014/0014340 A1 Jan. 16, 2014

(51) Int. Cl.

| | |
|---|---|
| ***E21B 34/14*** | (2006.01) |
| ***E21B 34/06*** | (2006.01) |
| ***E21B 33/12*** | (2006.01) |
| ***E21B 43/26*** | (2006.01) |
| ***E21B 43/28*** | (2006.01) |
| *E21B 34/00* | (2006.01) |

(52) U.S. Cl.

CPC ..... *E21B 34/14* (2013.01); *E21B 33/12* (2013.01); *E21B 34/06* (2013.01); *E21B 43/26* (2013.01); *E21B 43/28* (2013.01); *E21B 2034/007* (2013.01)

(58) Field of Classification Search

CPC . E21B 34/14; E21B 21/103; E21B 2034/007; E21B 34/063; E21B 34/06; E21B 43/26; E21B 33/12; E21B 43/28

See application file for complete search history.

(56) References Cited

U.S. PATENT DOCUMENTS

| | | | | |
|---|---|---|---|---|
| 5,024,273 | A | 6/1991 | Coone et al. | |
| 2008/0093080 | A1 | 4/2008 | Palmer et al. | |
| 2009/0008083 | A1 | 1/2009 | Themig et al. | |
| 2009/0056952 | A1 | 3/2009 | Churchill | |
| 2011/0114334 | A1 | 5/2011 | Palacios | |
| 2012/0205121 | A1 * | 8/2012 | Porter et al. | 166/373 |

OTHER PUBLICATIONS

International Search Report and Written Opinion, International Application No. PCT/US2013/044904, Date of Mailing Sep. 5, 2013, Korean Intellectual Property Office; International Search Report 5 pages, Written Opinion 8 pages.

Loyd East, et al. "State-of-the-art Multistage Fracturing to Help Achieve Branch Fracturing", Exploration & Production, vol. 8 Issue 2, Natural Gas, Touch Briefings 2010, Halliburton, pp. 76-78.

* cited by examiner

*Primary Examiner* — David Andrews
*Assistant Examiner* — Kristyn Hall
(74) *Attorney, Agent, or Firm* — Cantor Colburn LLP

(57) ABSTRACT

A downhole tool includes a tubular including a port. A first ball mechanism including a first shuttle axially movable within the tubular from a first position covering the port to a second position exposing the port. A first ball seat movable with the first shuttle and a second ball mechanism including a second shuttle axially movable within the tubular from a first position exposing the port to a second position covering the port. A second ball seat movable with the second shuttle, wherein an opening of the first ball seat is smaller than an opening of the second ball seat. Also includes a method of opening and closing a port in a downhole tubular and a method of completing downhole operations in a non-sequential order using a sleeve system having a plurality of downhole tools.

19 Claims, 11 Drawing Sheets

DOWNHOLE SLEEVE SYSTEM AND METHOD

BACKGROUND

In the drilling and completion industry, the formation of boreholes for the purpose of production or injection of fluid is common The boreholes are used for exploration or extraction of natural resources such as hydrocarbons, oil, gas, water, and alternatively for CO2 sequestration. For enhancing production and increasing extraction rates from a subterranean borehole, the formation walls of the borehole are fractured using a pressurized slurry, proppant containing fracturing fluid, or other treating fluids. The fractures in the formation wall are held open with the particulates once the injection of fracturing fluids has ceased.

A conventional fracturing system passes pressurized fracturing fluid through a tubular string that extends downhole through the borehole that traverses the zones to be fractured. The string may include valves that are opened to allow for the fracturing fluid to be directed towards a targeted zone. To remotely open the valve from the surface, a ball is dropped into the string and lands on a ball seat associated with a particular valve to block fluid flow through the string and consequently build up pressure uphole of the ball which forces a sleeve downhole thus opening a port in the wall of the string. When multiple zones are involved, the ball seats are of varying sizes with a downhole most seat being the smallest and an uphole most seat being the largest, such that balls of increasing diameter are sequentially dropped into the string to sequentially open the valves from the downhole end to an uphole end. Thus, the zones of the borehole are fractured in a "bottom-up" approach by starting with fracturing a downhole-most zone and working upwards towards an uphole-most zone.

While a typical frac job is completed sequentially in the bottom-up approach, an alternating stage process has been suggested in which a first interval is stimulated at a toe, a second interval is stimulated closer to the heel, and a third interval is fractured between the first and second intervals. Such a process has been indicated to take advantage of altered stress in the rock during the third interval to connect to stress-relief fractures from the first two intervals. However, accomplishing this process has only been capable with intervention requiring intricate manipulation from the surface or Intelligent Well System ("IWS") technology.

The art would be receptive to alternative devices and methods for alternating a sequence of a frac job.

BRIEF DESCRIPTION

A downhole tool includes a tubular including a port; a first ball mechanism including a first shuttle axially movable within the tubular from a first position covering the port to a second position exposing the port, and a first ball seat movable with the first shuttle; and a second ball mechanism including a second shuttle axially movable within the tubular from a first position exposing the port to a second position covering the port, and a second ball seat movable with the second shuttle, wherein an opening of the first ball seat is smaller than an opening of the second ball seat.

A sleeve system usable in a non-sequential order of exposing and covering ports, the sleeve system includes a plurality of downhole tools, at least one of the downhole tools including, a tubular including a port; a first ball mechanism including a first shuttle axially movable within the tubular from a first position covering the port to a second position exposing the port, and a first ball seat movable with the first shuttle; and a second ball mechanism including a second shuttle axially movable within the tubular from a first position exposing the port to a second position covering the port, and a second ball seat movable with the second shuttle, wherein an opening of the first ball seat is smaller than an opening of the second ball seat.

A method of opening and closing a port in a downhole tubular, the method includes stopping a first ball with a first ball seat, the first ball seat movable with a first shuttle covering the port; pressurizing the tubular to move the first shuttle and expose the port; stopping a second ball with a second ball seat uphole of the first ball seat, the second ball seat movable with a second shuttle; and, pressurizing the tubular to move the second shuttle and close the port.

A method of completing downhole operations in a non-sequential order using a sleeve system having a plurality of downhole tools, the method includes dropping a first ball down the sleeve system into a first ball seat of a first downhole tool; opening a first port in the first downhole tool; dropping a second ball down the sleeve system into a first ball seat of a second downhole tool; opening a second port uphole of the first port using the second downhole tool; dropping a third ball down the sleeve system into a second ball seat of the second downhole tool and closing the second port; releasing the second ball from the first ball seat of the second downhole tool, and releasing the third ball from the second downhole tool, the second ball landing on a first ball seat of a third downhole tool; and opening a third port downhole of the second port and uphole of the first port using the third downhole tool.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

An exemplary embodiment of a sleeve system 10 for permitting a fracturing or acid job to be completed with the stages out of sequence with respect to their position in a borehole 12 is shown in FIGS. 1-10. By "out of sequence", it should be understood that the sleeve system 10 described herein enables fracturing or acid jobs to be completed, using a series of downhole tools 14, in a sequence such as, but not limited to the first operation "1" being closest to a toe in the downhole direction 8, the second operation "2" being further uphole of the first operation "1", the third operation "3" being accomplished at a location between the first and second operations, and so on, with an operation "6" being a most uphole operation accomplished in this particular sequence, as will be described below with respect to FIG. 11. While the sleeve system 10 is suitable for permitting a fracturing or acid job with the stages out of sequence, the sleeve system 10 described herein is also usable for permitting jobs in other sequences, including a conventional sequence where an order of operations is completed in a "bottom-up" approach as well as usable in jobs other than fracturing or acid jobs.

Figure 1:
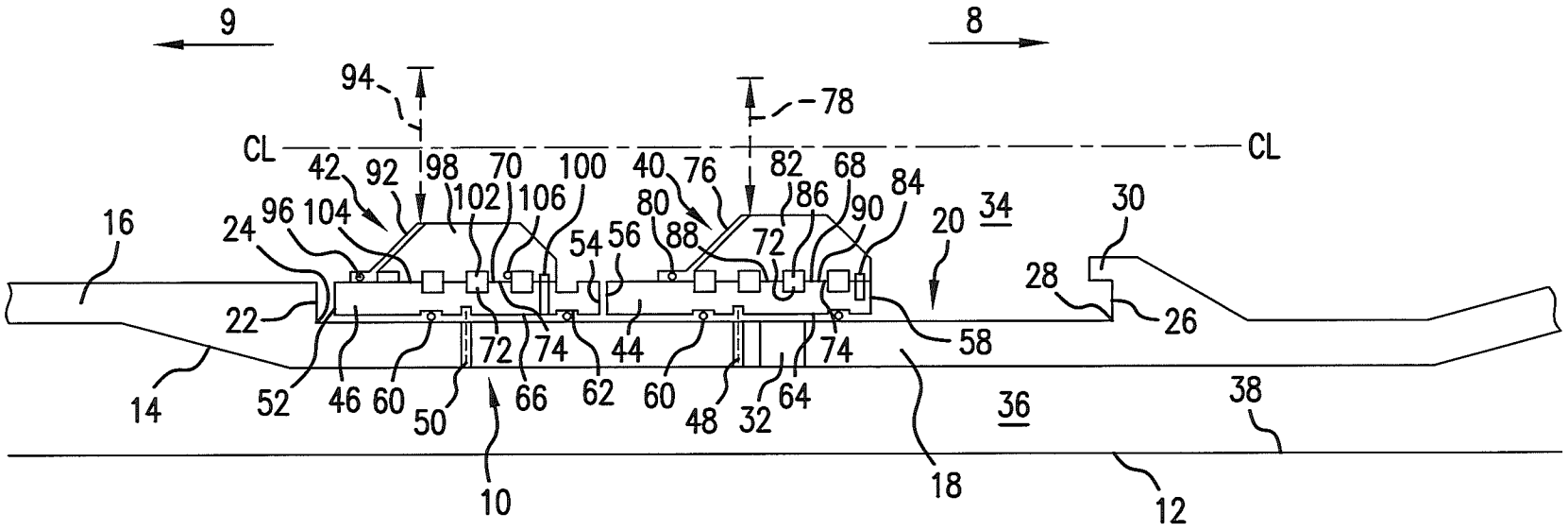
FIG. 1 depicts a cross sectional view of a portion of a downhole sleeve and port tool incorporating an exemplary embodiment of that downhole tool.

With reference to FIG. 1, a half-section of a portion of an exemplary embodiment of a downhole tool 14 or sleeve, such as a fracturing tool, is shown. The tool 14 includes a tubular 16, having a centerline CL, which is disposed in the borehole 12. The tubular 16 includes a ported sleeve valve 18 either mounted on the tubular 16 or forming a portion of the tubular 16. Within the sleeve valve 18, a radial indentation 20 having a ledge 22 at a first end 24, such as an uphole end, and a stop 26 at a second end 28, such as a downhole end. Also at the second end 28, and radially inward of the stop 26, a shifting step 30 protrudes longitudinally towards the first end 24 of the radial indentation 20. The sleeve valve 18 also includes a port 32, that is a lateral aperture, which provides access between an interior 34 of the tubular 16 and an annulus 36 of the borehole 12 between the tubular 16 and a formation wall 38 of the borehole 12. While only one port 32 is shown, it should be understood that several radially spaced apart ports 32 may be provided about a circumference of the sleeve valve 18.

Positioned radially inside of the sleeve valve 18 are a first ball mechanism 40, such as an opening ball mechanism, and a second ball mechanism 42, such as a closing ball mechanism. The first ball mechanism 40 includes a first shuttle 44, alternately termed a first shuttle sleeve, such as an opening shuttle, and the second ball mechanism 42 includes a second shuttle 46 or second shuttle sleeve, such as a closing shuttle. The first and second shuttles 44, 46 are in stacked longitudinal positions within the radial indentation 20 of the sleeve valve 18. That is, the first shuttle 44 is positioned closer to the second end 28 of the radial indentation 20 than the second shuttle 46, even when the longitudinal positionings of the first and/or second shuttles 44, 46 changes. In a run-in condition, as shown in FIG. 1, the first shuttle 44 is connected to the sleeve valve 18 by a release member 48, such as a shear screw, in a position where the first shuttle 44 is covering the port 32, and the second shuttle 46 is connected to the sleeve valve 18 by a release member 50, such as a shear screw, in a position where a first end 52 of the second shuttle 46 is adjacent the first end 24 of the radial indentation 20, and a second end 54 of the second shuttle 46 is adjacent a first end 56 of the first shuttle 44. A second end 58 of the first shuttle 44 faces, but is spaced from, the second end 28 of the radial indentation 20. Seals 60, such as O-ring seals, are interposed between the first and second shuttles 44, 46 and the sleeve valve 18. The first and second shuttles 44, 46 may include radial indentations 62 on exterior surfaces 64, 66 thereof to receive the seals 60 therein. Interior surfaces 68, 70 of the first and second shuttles 44, 46 include one or more engagement voids 72, for a purpose that will be described below. Adjacent each engagement void 72 is an engagement protrusion 74, such that the engagement voids 72 and protrusions 74 are alternatingly arranged. In the run-in position shown in FIG. 1, access between the annulus 36 and the interior 34 of the tubular 16 is prevented through the port 32 because the first shuttle 44 is positioned to cover the port 32.

The first ball mechanism 40 further includes a first ball seat 76, such as an opening ball seat, extending from the first shuttle 44. The first ball seat 76 includes a truncated conical shape for receiving a ball therein if the ball has a greater diameter than a diameter of an opening 78 in the first ball seat 76, or for passing a ball therethrough if the ball has a smaller diameter than the opening 78 in the first ball seat 76. A seal 80, such as an O-ring seal, is positionable between the first ball seat 76 and the first shuttle 44. The first ball seat 76 is supported by a first ball seat support 82, where the first ball seat support 82 extends further in a downhole direction than the first ball seat 76. The first ball seat support 82 is secured to the first shuttle 44 by a release member 84, such as a shear screw. The first ball seat support 82 includes one or more engagement voids 86 on an interior surface 88 thereof. Adjacent each engagement void 86 is an engagement protrusion 90 in an alternating pattern. In the run-in position, the engagement protrusions 90 of the first ball seat support 82 abut with the engagement protrusions 74 of the first shuttle 44.

The second ball mechanism 42 similarly includes a second ball seat 92, such as a closing ball seat, extending from the second shuttle 46. The second ball seat 92 includes a truncated conical shape for receiving a ball therein if the ball has a greater diameter than an opening 94 in the second ball seat 92, or for passing a ball therethrough if the ball has a smaller diameter than the opening 94 in the second ball seat 92. A seal 96, such as an O-ring seal, is positionable between the second ball seat 92 and the second shuttle 46. The second ball seat 92 is supported by a second ball seat support 98, where the second ball seat support 98 extends further in a downhole direction than the second ball seat 92. The second ball seat support 98 is secured to the second shuttle 46 by a release member 100, such as a shear screw. The second ball seat support 98 includes one or more engagement voids 102 on an interior surface 104 thereof. Adjacent each engagement void 102 is an engagement protrusion 106 in an alternating pattern. In the run-in position, the engagement protrusions 106 of the second ball seat support 98 abut with the engagement protrusions 74 of the second shuttle 46.

In the illustrated embodiment, the second ball seat 92 is positioned further uphole than the first ball seat 76, and the first ball seat 76 extends further radially inward than the second ball seat 92. That is, the first ball seat 76 has a smaller opening 78 than an opening 94 of the second ball seat 92.

Figure 2:
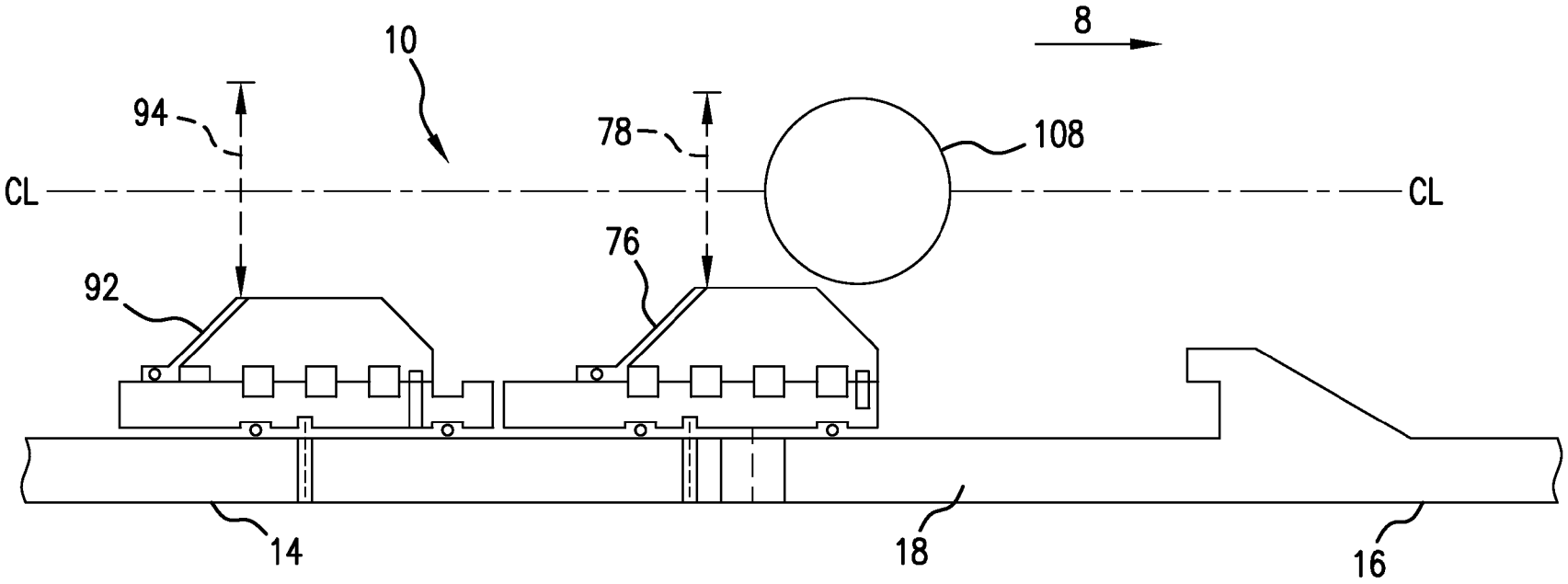
FIGS. 2-10 depict cross sectional views of the portion of the exemplary embodiment of the downhole tool of FIG. 1 in an exemplary actuation sequence.

FIGS. 2-10 show an actuation sequence of an exemplary method of employing the tool 14 shown in FIG. 1. As shown in FIG. 2, a first ball 108, is passed through the ported sleeve valve 18 and tubular 16 in the downhole direction 8 to actuate tools (not shown) further downhole. In order for the first ball 108 to pass the second ball seat 92 and then the first ball seat 76, the first ball 108 has a diameter less than a size of the openings 94, 78 of the second and first ball seats 92, 76 so as not to become trapped therein.

Figure 3:
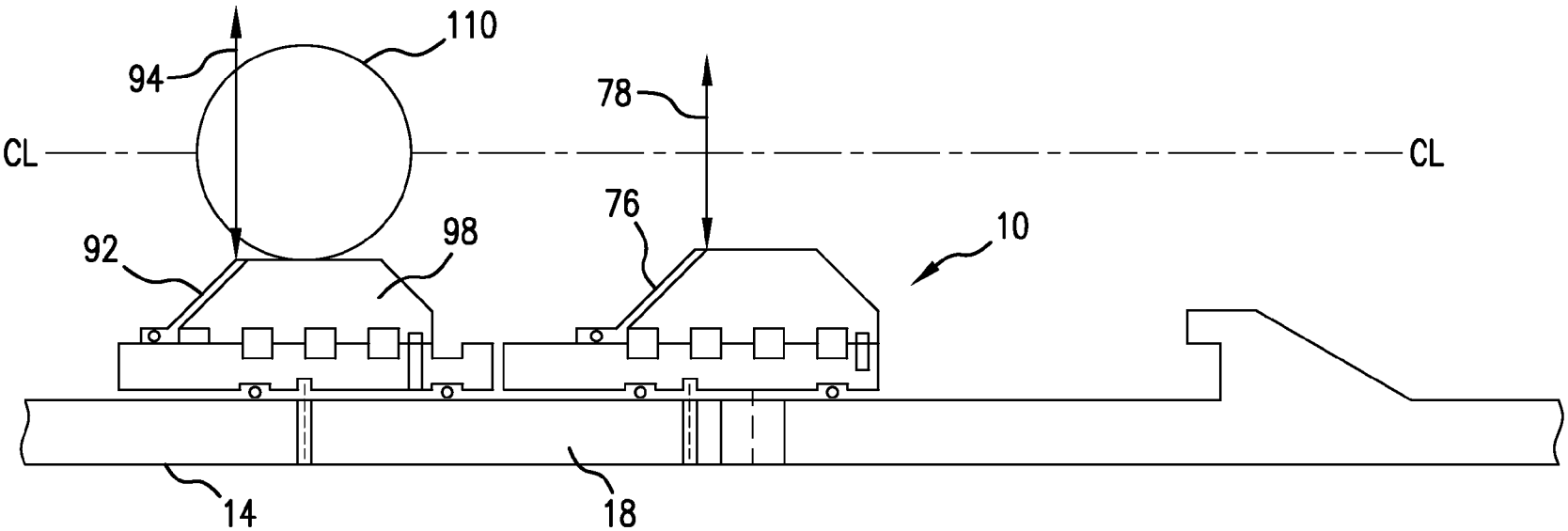
Figure 4:
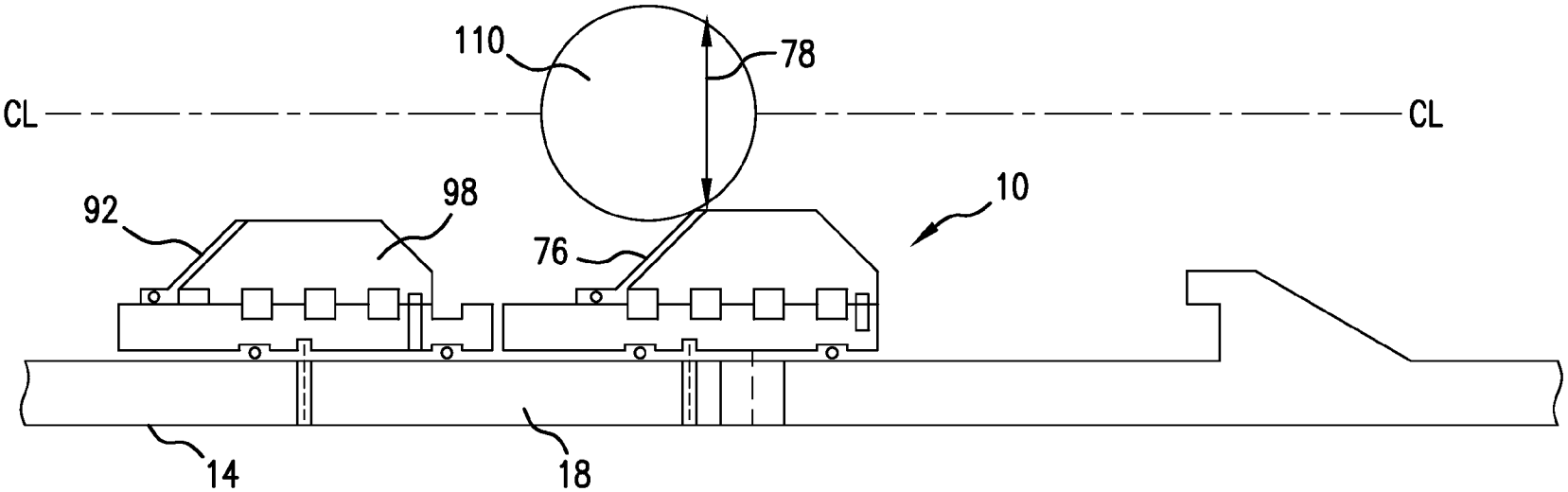

Then, as shown in FIG. 3, a second ball 110, is passed into the ported sleeve valve 18. The second ball 110 has a diameter that is larger than the diameter of the first ball 108, smaller than the opening 94 of the second ball seat 92, and larger than the opening 78 of the first ball seat 76. Due to the second ball 110 having a smaller diameter than the opening 94 of the second ball seat 92, the second ball 110 passes through the second ball seat 92 and the second ball seat support 98 as shown in FIG. 3. Due to the second ball 110 having a larger diameter than the opening 78 of the first ball seat 76, the second ball 110 lands on the first ball seat 76 as shown in FIG. 4.

Figure 5:
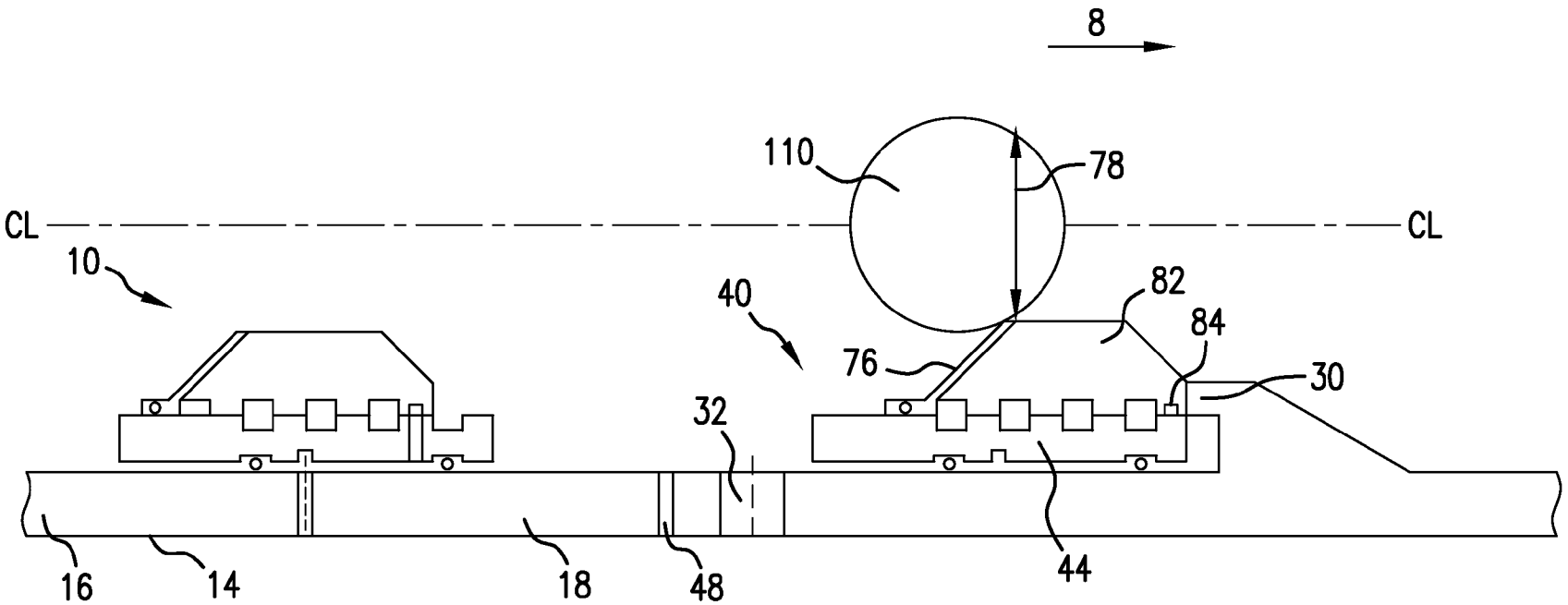

Turning now to FIG. 5, after the second ball 110 lands on the first ball seat 76, pressure is supplied within the tubular 16 uphole of the second ball 110. Pressure is thus applied to the second ball 110, which in turn applies pressure to the first ball seat 76, the first ball seat support 82, and the first shuttle 44 connected to the first ball seat support 82 via the release member 84. With pressure applied to the first shuttle 44 in a first direction (such as the downhole direction 8), the first shuttle 44 is sheared or otherwise released from the sleeve valve 18 by a releasing or shearing of the release member 48. Once the first shuttle 44 is separated from the sleeve valve 18, the pressure on the second ball 110 pushes the first ball seat 76, first ball seat support 82, and connected first shuttle 44 in the downhole direction 8 until the first ball seat support 82 abuts with the shifting step 30. Movement of the first shuttle 44 in the downhole direction 8 uncovers the port 32 in the sleeve valve 18, and thus the first ball mechanism 40 is an opening ball mechanism because it is capable of opening the port 32. At this point, the second ball 110 has enabled the opening of the port 32 and a fracturing job, slurry, acid job, and the like may be pumped through the port 32, although alternative downhole procedures may also be accomplished through the port 32.

Figure 6:
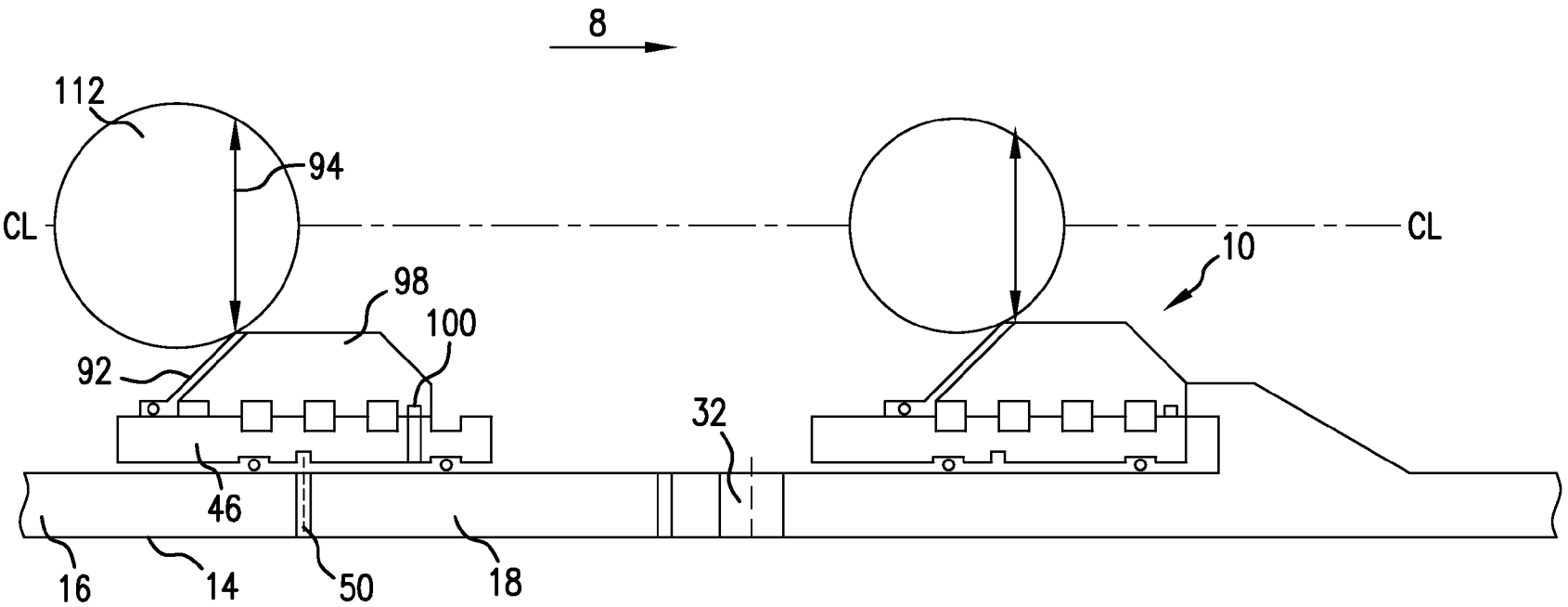

Turning now to FIG. 6, at a subsequent time, such as after a job is completed through the port 32, a third ball 112, is dropped into the tubular 16. The third ball 112 has a larger diameter than both the first ball 108 and the second ball 110. The third ball 112 also has a larger diameter than the opening 94 of the second ball seat 92. When the third ball 112 reaches the second ball seat 92, it lands on the second ball seat as shown in FIG. 6. Pressure is supplied within the tubular 16 uphole of the third ball 112. Pressure is thus applied to the third ball 112, which in turn applies pressure to the second ball seat 92, second ball seat support 98, and the second shuttle 46 connected to the second ball seat support 98 by the release member 100. With pressure applied to the second shuttle 46 in the direction 8, the second shuttle 46 is sheared or otherwise released from the sleeve valve 18 by a shearing or releasing of the release member 50.

Figure 7:
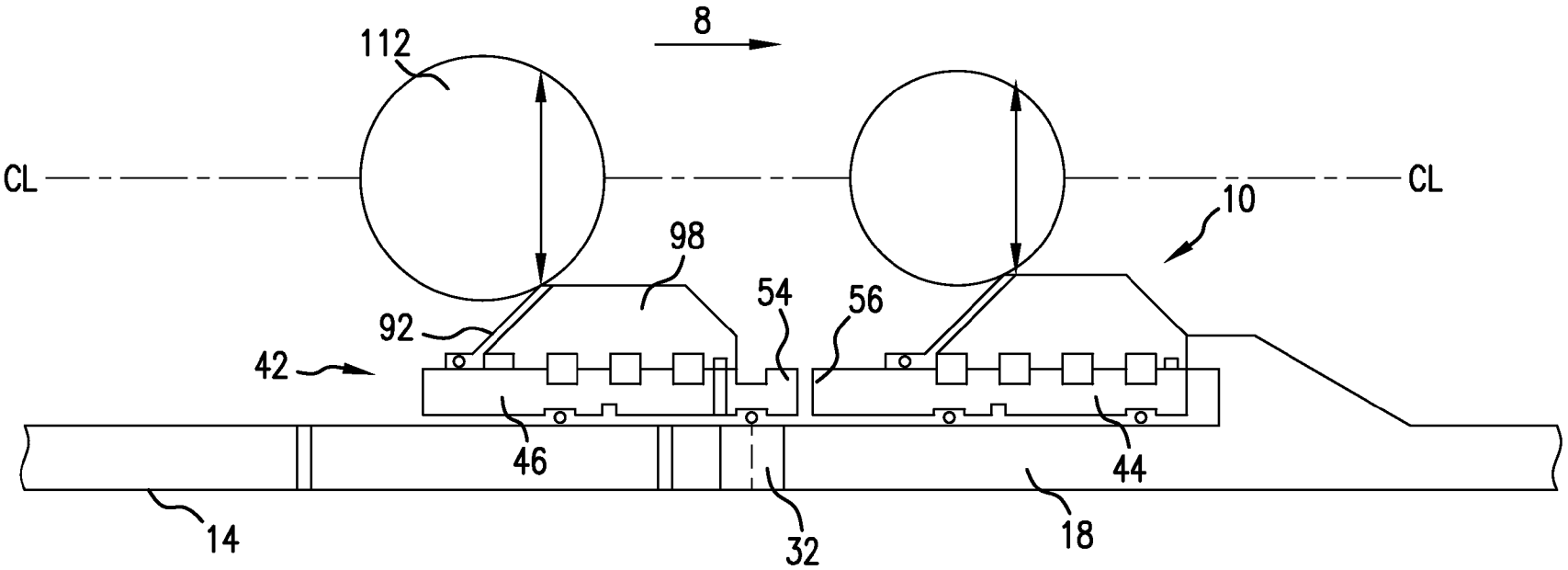

As shown in FIG. 7, once the second shuttle 46 is separated from the sleeve valve 18, continued pressure on the third ball 112 pushes the second ball seat 92, second ball seat support 98, and second shuttle 46 in the direction 8 such that the second shuttle 46 covers and closes the port 32. Thus, the second ball mechanism 42 is a closing ball mechanism due to its ability to close the port 32. The second shuttle 46 moves in the direction 8 until the second shuttle 46, such as the second end 54 of the second shuttle 46, abuts with the first shuttle 44, such as the first end 56 of the first shuttle 44.

Figure 8:
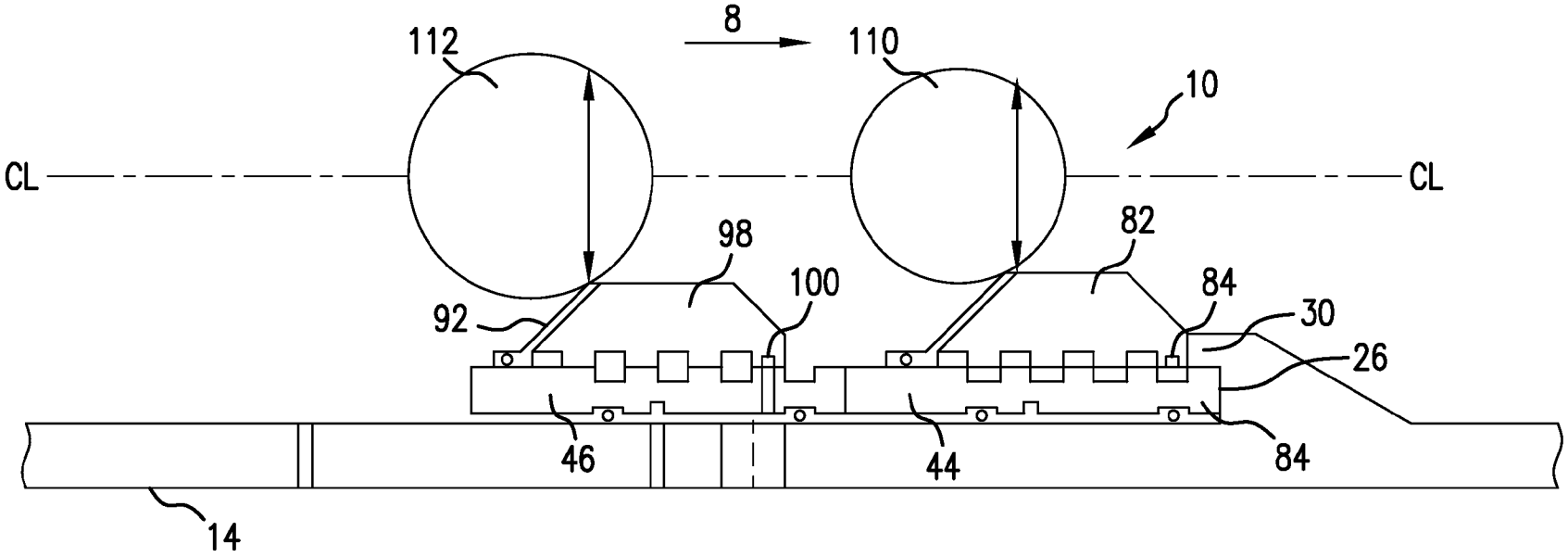

With reference to FIG. 8, pressure applied to the third ball 112 transfers force through the second ball seat 92, the second ball seat support 98, the release member 100, the second shuttle 46, the first shuttle 44, release member 84, and first ball seat support 82 to the shifting step 30. The release member 84 that secured the first ball seat support 82 to the first shuttle 44 is sheared or otherwise released when the first shuttle 44 is pushed in the direction 8 towards the stop 26 but the first ball seat support 82 is prevented from moving in the direction 8 by the shifting step 30.

Figure 9:
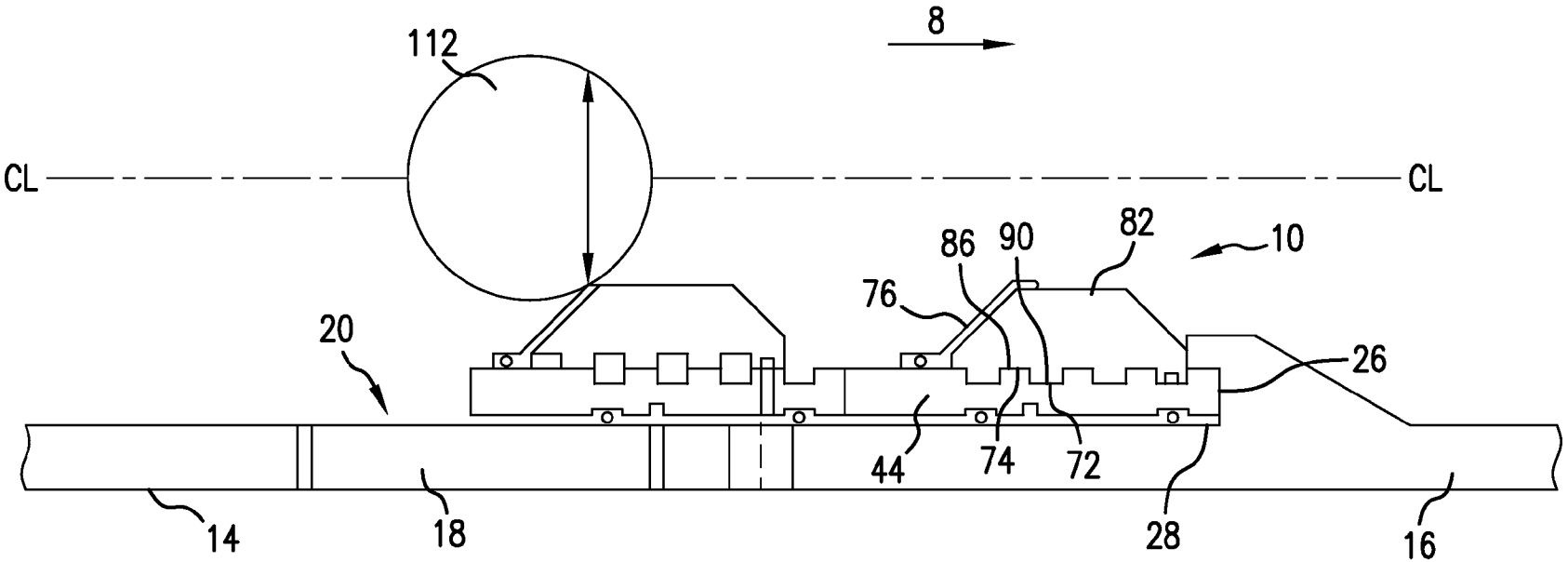

FIG. 9 shows the first shuttle 44 translated axially relative to the first ball seat 76 and first ball seat support 82, allowing the first ball seat support 82 to collapse radially outward into the engagement voids 72 of the first shuttle 44. To translate axially in direction 8, the first shuttle 44 moves toward the stop 26 at the second end 28 of the radial indentation 20 of the sleeve valve 18. That is, prior to axial translation of the first shuttle 44 relative to the first ball seat support 82, the engagement protrusions 74 of the first shuttle 44 are aligned with the engagement protrusions 90 of the first ball seat support 82, and the engagement voids 72 of the first shuttle 44 are aligned with the engagement voids 86 of the first ball seat support 82 as shown in FIG. 1. After axial translation of the first shuttle 44 as shown in FIG. 9, the engagement protrusions 90 of the first ball seat support 82 mesh, nest, or otherwise collapse within the engagement voids 72 of the first shuttle 44 and the engagement protrusions 74 of the first shuttle 44 nest within the engagement voids 86 of the first ball seat support 82. The first ball seat support 82 may be segmented such that the segmentation thereof allows for the change in internal diameter. It should be understood that segments of the first ball seat support 82 are clustered closer together in FIG. 1 than in FIG. 9. After the first ball seat support 82 expands radially outward into the first shuttle 44, pressure uphole of the second ball 110 (shown previously in FIG. 8) also forces radial outward deformation of the first ball seat 76, allowing the second ball 110 to move past the first ball seat 76 and further down the tubular 16 in direction 8.

Figure 10:
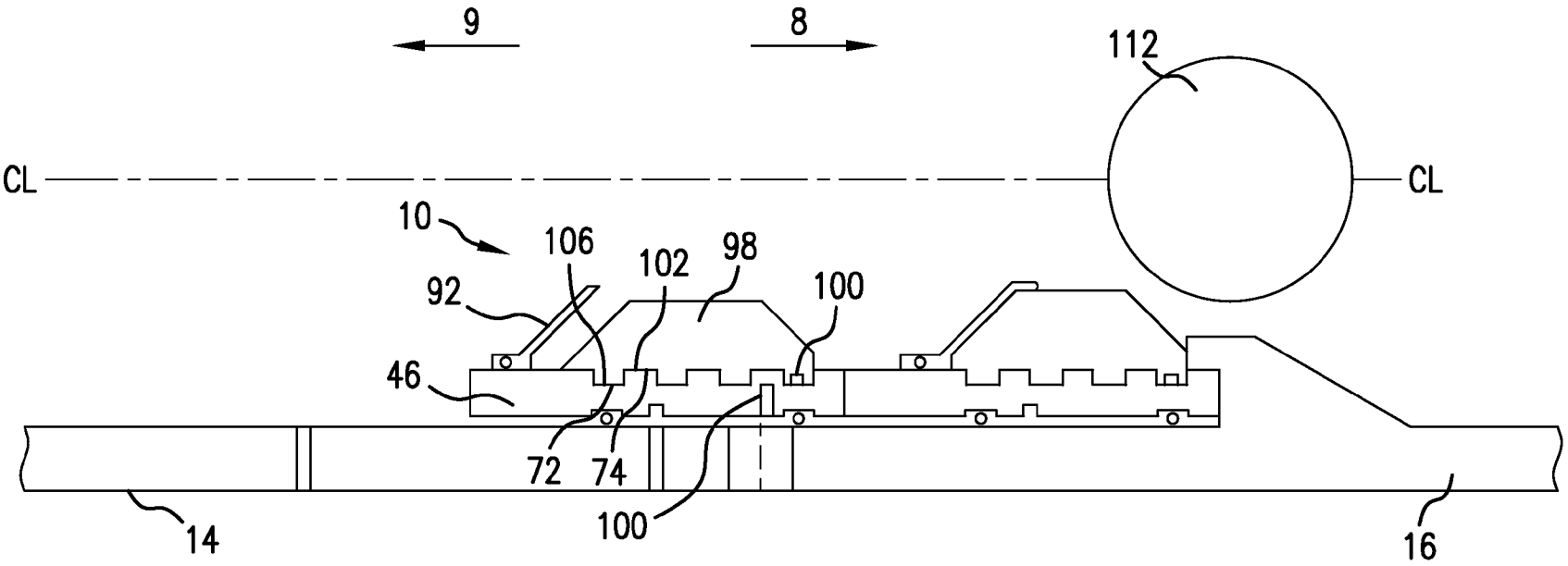

As shown in FIG. 10, additional pressure on the third ball 112 will cause the release member 100 to shear or otherwise release, allowing the second ball seat support 98, which may also include segmentation, to collapse radially outward into the engagement voids 72 of the second shuttle 46. That is, prior to the additional pressure on the third ball 112, the engagement protrusions 74 of the second shuttle 46 are aligned with the engagement protrusions 106 of the second ball seat support 98, and the engagement voids 72 of the second shuttle 46 are aligned with the engagement voids 102 of the second ball seat support 98 (as shown in FIG. 1). After the additional pressure is applied on the third ball 112 and the release member 100 is broken, the engagement protrusions 106 of the second ball seat support 98 mesh, nest, or otherwise collapse within the engagement voids 72 of the second shuttle 46 and the engagement protrusions 74 of the second shuttle 46 nest or otherwise fit within the engagement voids 102 of the second ball seat support 98. Pressure uphole of the third ball 112 then forces radial outward deformation of the second ball seat 92, allowing the third ball 112 to pass the second ball seat 92 and move axially down the tubular 16 in the direction 8. In an exemplary embodiment, the first, second, and third balls 108, 110, and 112, may be made from a material that dissolves or disintegrates after a predetermined time such that they do not need to flow back in direction 9.

Figure 11:
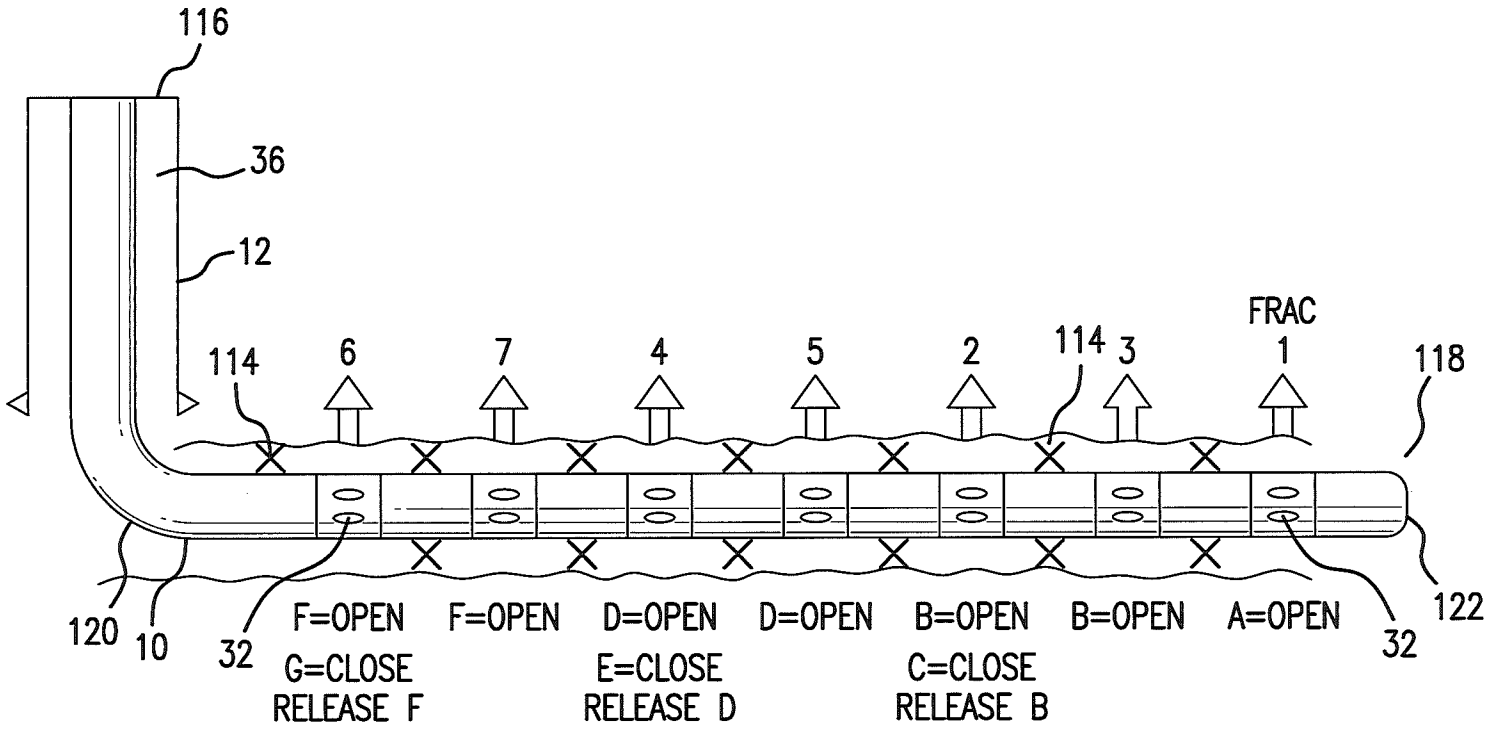
FIG. 11 depicts a side view of an exemplary embodiment of the sleeve system of FIG. 1, having multiple downhole tools, in a borehole and depicting an exemplary frac stage order.

The present invention provides means to realize the method of altering the sequence of the frac job or other stimulation. In one exemplary embodiment, devices described herein may be alternated in sequence up the borehole with industry accepted conventional single ball shifted sleeves. FIG. 11 illustrates the sleeve system 10 within borehole 12, the borehole 12 extending from an uphole location 116, such as a surface, to a downhole location 118. The borehole 12 may be a horizontal borehole as shown, and the sleeve system 10 includes a heel portion 120 at a bend of the sleeve system 10, and a toe portion 122 at a downholemost end of the sleeve system 10. Packers and/or anchors 114 isolate sections of the annulus 36 surrounding the ports 32. The sleeve system 10 may further include any number of tubulars to complete the string. An exemplary order of operations is indicated within the borehole 12, with "Frac 1" indicating that the ports 32 nearest the toe portion 122 are opened first using Ball A. Frac "2" indicates that the ports 32 further uphole from the toe portion 122 are opened next using Ball B to operate the tool 14 shown in FIG. 1 and the ports are subsequently closed using Ball C after completion of Frac "2". Frac "3" indicates that the ports 32 between the locations for Frac "1" and Frac "2" are opened third using the Ball B which was released from the Frac "2" location. Subsequently, Frac "4" indicates that the ports 32 further uphole from the Frac "2" location are opened next using Ball D and are subsequently closed using Ball E after completion of Frac "4". Frac "5" indicates that the ports 32 between the locations for Frac "4" and Frac "2" are opened using the Ball D which was released from the Frac "4" location. Then, Frac "6" indicates that the ports 32 are opened further uphole from the location of Frac "4" using a Ball F, and are subsequently closed using Ball G. Frac "7" indicates that the ports 32 between the locations for Frac "6" and Frac "4" are opened using the Ball F that is released from the Frac "6" location. While seven fracturing locations are shown, any number of fracturing locations may be addressed using the sleeve system 10, which may include any number of downhole tools 14 and conventional ball shifted sleeves in alternating locations. Thus, a method is provided for employing a sleeve system 10 having a series of downhole tools 14 in an alternative fracturing order of operations, using balls and sleeves instead of intervention or IWS technology. In the exemplary embodiment shown in FIG. 11, the sleeves for stages 1, 3, 5, and 7 are standard sleeves, while the downhole tools 14 are employed for stages 2, 4, and 6.

The exemplary sleeve system 10 described herein permits the stimulation of a reservoir with a "ball and sleeve" multi-stage stimulation system with the stages out of sequence with respect to their position in the borehole 12. The exemplary embodiments described herein would allow for a change from a typical frac job employing the traditional "bottom up" approach (performed sequentially from a downhole location, such as a toe, to a more uphole location such as a heel) to an alternating stage process in which a first interval is stimulated near a toe, a second interval is stimulated closer to a heel, and a third interval is fractured between the first and second intervals. This change in sequence changes the characteristics of pressurization of the formation during a pressure stimulation of a reservoir.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed:

1. A downhole tool comprising:

a tubular including a port;

a first ball mechanism including a first shuttle axially movable within the tubular from a first position covering the port to a second position exposing the port, a first ball seat movable with the first shuttle, and a first ball seat support supporting the first ball seat, the first ball seat support positioned radially interiorly of the first shuttle, the first ball seat support releasably connected to the first shuttle in a first condition of the first ball mechanism, and the first shuttle shifted with respect to the first ball seat support in a second condition of the first ball mechanism; and a second ball mechanism including a second shuttle axially movable within the tubular from a first position exposing the port to a second position covering the port, and a second ball seat movable with the second shuttle, wherein an opening of the first ball seat is smaller than an opening of the second ball seat.

2. The downhole tool of claim 1, wherein the first shuttle is longitudinally separated from the second shuttle, and the first shuttle is positioned further downhole than the second shuttle.

3. The downhole tool of claim 1, wherein the first ball mechanism and second ball mechanism are secured to the tubular by release members in the first positions thereof.

4. The downhole tool of claim 1, wherein the first ball seat support is movable radially outward towards the first shuttle in the second condition.

5. The downhole tool of claim 4, wherein the first shuttle includes alternating engagement voids and protrusions and the first ball seat support includes alternating engagement voids and protrusions that mesh with the engagement voids and protrusions of the first shuttle when the first ball seat support is separated from the first shuttle and the first shuttle is shifted relative to the first ball seat support within the tubular.

6. The downhole tool of claim 4, further comprising a second ball seat support supporting the second ball seat and releasably connected in a first condition to the second shuttle, the second ball seat support movable radially outward in a second condition after separation from the second shuttle.

7. The downhole tool of claim 4, wherein the first ball seat has a first opening in the first condition of the first ball seat support and a second opening larger than the first opening in the second condition of the first ball seat support.

8. The downhole tool of claim 4, wherein the tubular includes a shifting step, the first ball seat support movable from the first condition to the second condition after abutment with the shifting step.

9. The downhole tool of claim 8, wherein the second shuttle abuts with the first shuttle to axially move the first shuttle relative to the first ball seat support.

10. The downhole tool of claim 1, wherein the second shuttle is axially movable to abut with the first shuttle to move the first shuttle axially.

11. The downhole tool of claim 1, wherein, upon receiving a ball in the first ball seat, tubular pressure within the tubular axially moves the first shuttle to the second position.

12. The downhole tool of claim 1, wherein the first ball seat support is segmented, and wherein the second ball mechanism further comprises a second segmented ball seat support supporting the second ball seat.

13. The downhole tool of claim 12, wherein the second ball seat support is releasably connected to the second shuttle.

14. A downhole tool comprising:

a tubular including a port;

a first ball mechanism including a first shuttle axially movable within the tubular from a first position covering the port to a second position exposing the port, a first ball seat movable with the first shuttle, and a first ball seat support supporting the first ball seat and releasably connected in a first condition to the first shuttle; and a second ball mechanism including a second shuttle axially movable within the tubular from a first position exposing the port to a second position covering the port, and a second ball seat movable with the second shuttle, wherein an opening of the first ball seat is smaller than an opening of the second ball seat;

wherein the tubular includes an internal radial indentation, the first shuttle and second shuttle releasably connected within the radial indentation in the first positions thereof.

15. A sleeve system usable in a non-sequential order of exposing and covering ports, the sleeve system comprising a plurality of downhole tools, at least one of the downhole tools including:

a tubular including a port;

a first ball mechanism including a first shuttle axially movable within the tubular from a first position covering the port to a second position exposing the port, a first ball seat movable with the first shuttle, and a first ball seat support supporting the first ball seat, the first ball seat support positioned radially interiorly of the first shuttle, and the first ball seat support releasably connected in a first condition to the first shuttle and collapsible radially outwardly into the first shuttle in a second condition; and a second ball mechanism including a second shuttle axially movable within the tubular from a first position exposing the port to a second position covering the port, and a second ball seat movable with the second shuttle, wherein an opening of the first ball seat is smaller than an opening of the second ball seat;

wherein the plurality of downhole tools includes first, second, and third downhole tools arranged sequentially in a downhole to uphole manner in the sleeve system, and the port in the second downhole tool is exposed by moving a first shuttle in the second downhole tool after covering a port in the third downhole tool.

16. The sleeve system of claim 15 wherein the first ball seat support is segmented, and wherein the second ball mechanism further includes a second ball seat support that is segmented.

17. A method of opening and closing a port in a downhole tubular, the method comprising:

stopping a first ball with a first ball seat, the first ball seat movable with a first shuttle covering the port, the first ball seat supported by a first ball seat support;

pressurizing the tubular to move the first shuttle and expose the port;

stopping a second ball with a second ball seat uphole of the first ball seat, the second ball seat movable with a second shuttle;

pressurizing the tubular to move the second shuttle and close the port; and, abutting the first shuttle with the second shuttle to shift the first shuttle relative to the first ball seat support.

18. The method of claim 17, further comprising collapsing the first ball seat support radially outwardly into the first shuttle;

releasing the first ball down the tubular;

pressurizing the tubular to collapse a second ball seat support radially outwardly into the second shuttle; and releasing the second ball down the tubular.

19. A method of completing downhole operations in a non-sequential order using a sleeve system having a plurality of downhole tools, the method comprising:

dropping a first ball down the sleeve system into a first ball seat of a first downhole tool;

opening a first port in the first downhole tool;

dropping a second ball down the sleeve system into a first ball seat of a second downhole tool;

opening a second port uphole of the first port using the second downhole tool;

dropping a third ball down the sleeve system into a second ball seat of the second downhole tool and closing the second port;

releasing the second ball from the first ball seat of the second downhole tool, and releasing the third ball from the second downhole tool, the second ball landing on a first ball seat of a third downhole tool; and opening a third port downhole of the second port and uphole of the first port using the third downhole tool;

wherein at least one of the first, second, and third downhole tools includes a first shuttle axially movable within the tubular from a first position covering a port in the tubular to a second position exposing the port, a first ball seat movable with the first shuttle, a first ball seat support supporting the first ball seat, a second shuttle axially movable within the tubular from a first position exposing the port to a second position covering the port, the second shuttle axially abutting the first shuttle to shift the first shuttle relative to the first ball seat support, and a second ball seat movable with the second shuttle.

* * * * *